US005954541A

United States Patent [19]

Ozai et al.

[11] Patent Number: 5,954,541

[45] Date of Patent: Sep. 21, 1999

[54] ELECTRICAL CONNECTOR AND METHOD FOR CONNECTING CABLE TO THE SAME

[75] Inventors: Kazuyuki Ozai; Hirokazu Takahashi, both of Tokyo, Japan

[73] Assignee: DDK Ltd., Japan

[21] Appl. No.: 08/953,846

[22] Filed: Oct. 14, 1997

[51] Int. Cl.[6] ..... H01R 13/648

[52] U.S. Cl. ..... 439/608; 439/404

[58] Field of Search ..... 439/607, 608, 439/610, 79, 395, 404

[56] References Cited

U.S. PATENT DOCUMENTS 5,605,476 2/1997 McNamara et al. ..... 439/608

*Primary Examiner*—Khiem Nguyen
*Attorney, Agent, or Firm*—Silverman, Cass & Singer, Ltd.

[57] ABSTRACT

An electrical connector to be connected to a cable comprises a housing having a contact receiving portion therein, plural sets of contact pairs arranged in a row in the contact receiving portion of the housing, and a shield plate provided between at least two adjacent contact pairs. The shield plate serves to prevent occurrence of cross talk as much as possible.

7 Claims, 22 Drawing Sheets

ELECTRICAL CONNECTOR AND METHOD FOR CONNECTING CABLE TO THE SAME

BACKGROUND OF THE INVENTION

This invention relates to an electrical connector to be connected to a cable and a method for connecting the cable to the connector.

As well known, various kinds of signals are transmitted and received through cables between electronic appliances, for example, between a personal computer and peripheral equipment, and occasionally driving power may be supplied from the personal computer to the peripheral equipment by the use of the same cable.

One example of such a cable is shown in FIGS. 31 and 32. The cable 100 shown in FIGS. 31 and 32 comprises a pair of forward direction signal wires 111*a* and 111*b* for feeding signals from the personal computer to the peripheral equipment and a pair of backward direction signal wires 112*a* and 112*b* for returning signals from the peripheral equipment to the personal computer. The signal wires 111*a* and 111*b* and 112*a* and 111*b* are respectively twisted together and covered with aluminum tapes 113 wound therearound and further covered with individual shield braids 114. These signal wires 111*a*, 111*b*, 112*a* and 112*b* are twisted together with a pair of power supply wires 115*a* and 115*b* (one of supply wires may be a bare wire) and a bare drain wire 116 to form a cable core 110.

By these twisting treatments, the drain wire 116 (including a bare wire if one of the power supply wires 115*a* and 115*b* is the bare wire) is brought into close contact with the individual shield braids 114 of the signal wires to be electrically contact with the shield braids.

Thereafter, the cable core 110 thus constructed is covered with a metal laminate tape 117 consisting of an aluminum foil on one side and a plastic insulating layer on the other side and wound on the cable core 110. The laminate tape 117 is further covered with an outer shield braid 118 and a sheath 119 of a plastic insulating material.

In connecting the personal computer and the peripheral equipment by means of a cable constructed as described above, in general, one end of the cable 100 is connected to an electrical connector which is then mounted in part (connector mounting portion) of the personal computer or peripheral equipment. In practically connecting the cable 100 and the electrical connector, first the shield braids or the like of the cable 100 at the cable end are partially removed to exposed ends of the wires which are then connected to connecting terminals (contacts) of the electrical connector by soldering, crimping (by collapsing metal pieces or sleeves) or piercing wires with knife edges of grooves of the contacts.

With such a connection between the cable and the connector described above, no problems occur, when it is satisfied with transmission characteristics at normal levels. However, in order to obtain transmission characteristics with higher accuracy for use within a range of higher frequencies, it has been a found by the research of the inventors of the present application that more careful precautions are required in connecting the cable and the electrical connector.

In more detail, even if the construction of a cable itself is substantially complete in transmission characteristics, deterioration in transmission characteristics is unavoidable unless the connection is effectively performed. It has been found that if the connection is not effectively performed, any transmission characteristics could not be sufficiently utilized no matter how a cable is superior as the cable 100 shown in FIGS. 31 and 32.

In view of this, the inventors have further earnestly investigated the connection between the cable and the connector, as a result of which the following facts have been clarified.

(1) In the past, when internal wires were taken out after partial removal of shield braids of a cable, any strict examination on wiring lengths of the wires was not effected for use at the normal level of transmission characteristics. For example, when employing the soldering or crimping described above, it is required to lengthen the wires to a certain extent owing to its construction. However, the longer the wires, the longer becomes the mismatching portion of impedance.

(2) In the past, moreover, with a tape cable, respective wires were dispensed in a relatively accurately, while on the other hand with a circular cable having longitudinally twisted wires mingled with one another for example as the cable 100 shown in FIGS. 31 and 32, the wires were often crossed or entangled with one another and directed in irregular directions because of no strict consideration in wiring for connecting the wires to contacts of an electrical connector. As a result, the cross talk and transmission losses were not avoided.

(3) Moreover, even if the shielding between the signal wires of a cable and the shielding of the cable as a whole are complete in order to prevent any occurrence of cross talk or the like, the cross talk may occur if the shielding in an electrical connector to be connected to the cable should not be complete.

SUMMARY OF THE INVENTION

It is a principal object of the invention to provide an electrical connector capable of effectively suppressing the cross talk and transmission losses as much as possible even in the zone of higher frequencies and a method of connecting a cable to the electrical connector.

In order to achieve this object, the electrical connector according to the invention comprises a housing having a contact receiving portion therein, a plurality of contacts arranged in a row in said contact receiving portion of the housing, and a shield plate provided between at least two adjacent contacts.

The electrical connector according to the another aspect of the invention comprises a housing having a contact receiving portion therein, plural sets of contact pairs arranged in a row in said contact receiving portion of the housing, and a shield plate provided between at least two adjacent contact pairs.

With another aspect of the invention, the method for connecting a cable to an electrical connector, said cable including a cable core composed of sets of signal pair wires covered with individual shield braids and a bare drain wire interposed between said sets of signal pair wires, an outer shield braid covering said cable core and a sheath covering said outer shield braid, and said electrical connector including a housing having a contact receiving portion therein, a plurality of contacts arranged in a row in said contact receiving portion, each of said contacts having at its leading end connection portion a knife-edged groove for piercing connection, and a shield plate provided between at least two adjacent contact pairs for said signal pair wires, wherein the method comprises steps of:

exposing said wires at one end of said cable to be connected by partially removing said shield braids or others;

preparing a wire distribution block having wire passing holes through which said exposed sets of signal pair wires and said bare drain wire are passed and wire distribution grooves formed and distributed in two directions in the front end surface of said wire distribution block, and passing said sets of signal pair wires and bare drain wire through said wire passing holes, while distributing said sets of signal pair wires and bare drain wire extended through said wire passing holes to fit these wires in said wire distribution grooves;

cutting off parts of said distributed sets of signal pair wires and bare drain wire extending from said wire distribution grooves;

mounting a block cover on said wire distribution block; and forcing said wire distribution block with said cable connected thereto to the wire connection portion of said electrical connector through said block cover to pierce said knife-edged grooves of the corresponding contacts into conductors of said sets of signal pair wires and bare drain wire fitted in said wire distribution grooves to electrically connect said cable to said electrical connector.

With a further aspect of the invention, the method for connecting a cable to an electrical connector, said cable including a cable core composed of sets of signal pair wires covered with individual shield braids, a pair of power supply wires interposed between said signal pair wires and a bare drain wire interposed between said sets of signal pair wires and in electrical contact with individual shield braids of said signal pair wires, an outer shield braid covering said cable core and a sheath covering said outer shield braid, and said electrical connector including a housing having a contact receiving portion therein, a plurality of contacts arranged in a row in said contact receiving portion, each of said contacts having at its leading end connection portion a knife-edged groove for piercing connection, and a shield plate provided between at least two adjacent contact pairs for said signal pair wires, wherein the method comprises steps of:

exposing said wires at one end of said cable to be connected by partially removing said shield braids or others;

preparing a wire distribution block having wire passing holes through which said exposed sets of signal pair wires, said pair of power supply wires and said bare drain wire are passed and wire distribution grooves formed and distributed in two directions in the front end surface of said wire distribution block, and passing said sets of signal pair wires, pair of power supply wires and said bare drain wire through said wire passing holes, while distributing said sets of signal pair wires, pair of power supply wires and bare drain wire extended through said wire passing holes to fit these wires in said wire distribution grooves;

cutting off parts of said distributed sets of signal pair wires, pair of power supply wires and bare drain wire extending from said wire distribution grooves;

mounting a block cover on said wire distribution block; and forcing said wire distribution block with said cable connected thereto to the wire connection portion of said electrical connector through said block cover to pierce said knife-edged grooves of the corresponding contacts into conductors of said sets of signal pair wires, pair of power supply wires and bare drain wire fitted in said wire distribution grooves to electrically connect said cable to said electrical connector.

In a preferred embodiment of the method according to the invention, the drain wire is connected to one of contacts in the housing.

In another preferred embodiment of the method according to the invention, part of the shield plate is brought into electrical contact with the contact in the housing, the contact being connected to the drain wire, whereby the shield plate is ground.

As can be seen from the above description, the electrical connector and the method of connecting a cable to the electrical connector according to the invention have the following significant advantages.

(1) As the shield plate is provided between at least one set of adjacent contacts in the housing according to the invention, the cross talk can be effectively prevented even if the connector is connected with a cable, for example, whose a pair of forward direction signal wires and a pair of backward direction signal wires are mingled with each other. Moreover, when the shield plate is ground, a good shield effect can be obtained.

(2) When the electrical connector according to the invention is combined with a cable provided with individual shield braids for shielding the respective signal wires and provided with an outer shield braid for shielding the entire cable, the occurrence of the cross talk can be effectively prevented even in the case using in the zone of higher frequencies. In other words, the electrical connector according to the invention causes the cable to exhibit its transmission characteristics sufficiently.

(3) Moreover, as the contacts received in the housing have the knife-edged grooves at their leading connection portions according to the invention, the piercing connection can be achieved in a simple manner only by forcing the wires with insulating covers to the connection portion when connecting the wires of the cable to the connector. Therefore, the troublesome operation for partially removing insulating layers of fine wires of a cable is not needed, thereby obtaining a good operation efficiency. Furthermore, as the contact exclusive for the drain wire is provided in the connector according to the invention, the piercing connection of the bare wire is also simply accomplished at the same time when the other wires are connected.

(4) As the wire distribution block for dividing the wires of the cable in two directions is used in connecting them to the contacts in the housing according to the invention, the wiring length of the wires can be made shortest, as a result of which the mismatching portion of impedance or the like can be suppressed to a minimum length. Moreover, the wiring divided into two directions described above eliminates the crossed wiring and entangled wiring so that the wires are fixed in rectilinear and uniform wiring, with the result that the cross talk and transmission losses can be effectively prevented.

The invention will be more fully understood by referring to the following detailed specification and claims taken in connection with the appended drawings.

DESCRIPTION OF THE PREFERRED EMBODIMENTS

Figure 1:
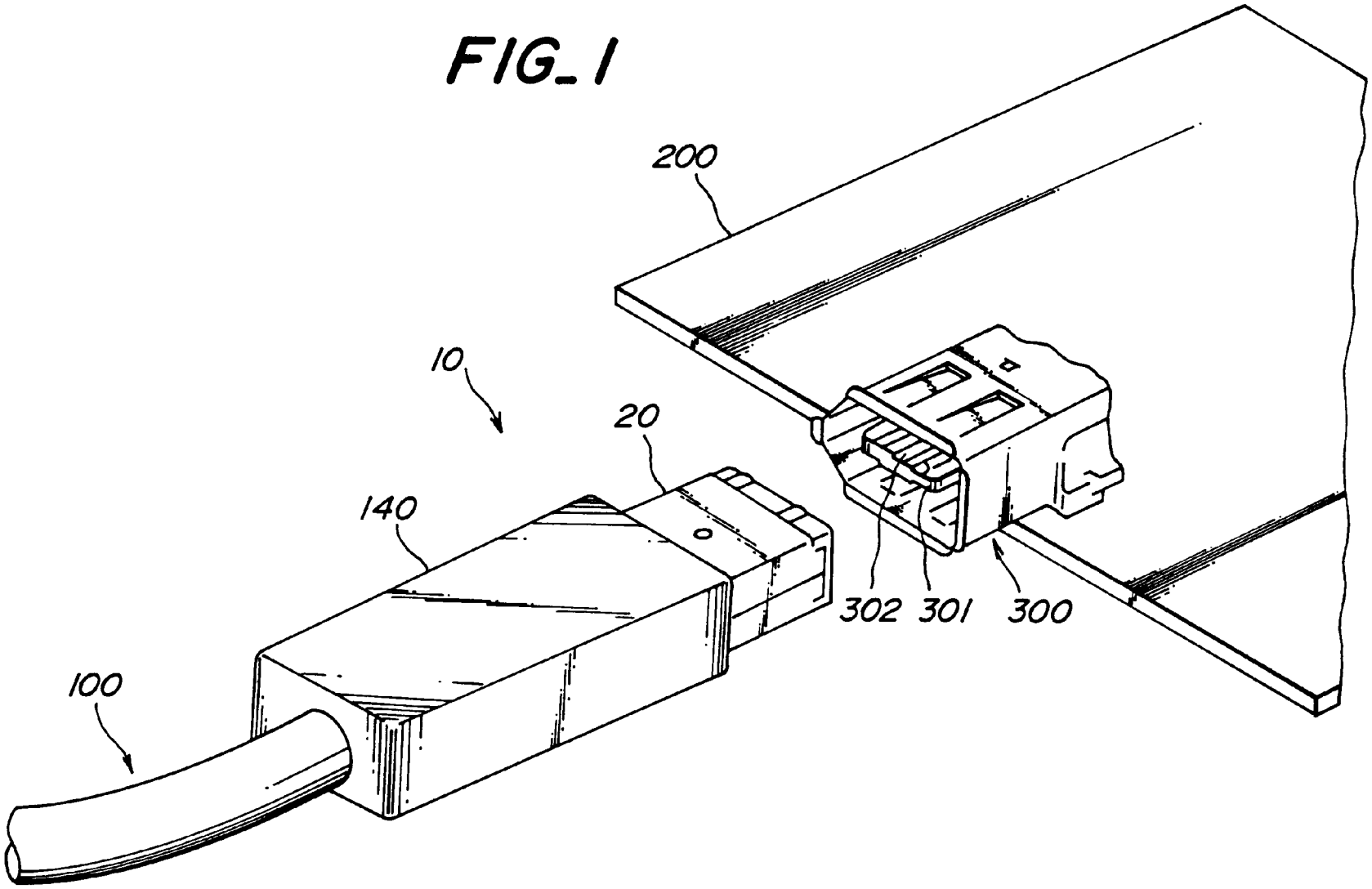
FIG. 1 is a perspective view schematically illustrating one example of used state of the electrical connector according to the invention.

FIGS. 1 to 4 show the manner of actual use of the electrical connector according to the present invention, which is defined precisely in claim 2 hereinafter. The drawings show also the overall construction of the connector. FIGS. 5 to 21 show more detailed construction of each part of the connector according to the present invention. In these figures, reference numeral 10 generally indicates the electrical connector of the present invention. Reference numeral 20 is the housing of the connector, 30 is cable wire distribution block, 40 block cover, 50 contact and 60 is the shield plate.

Figure 31:
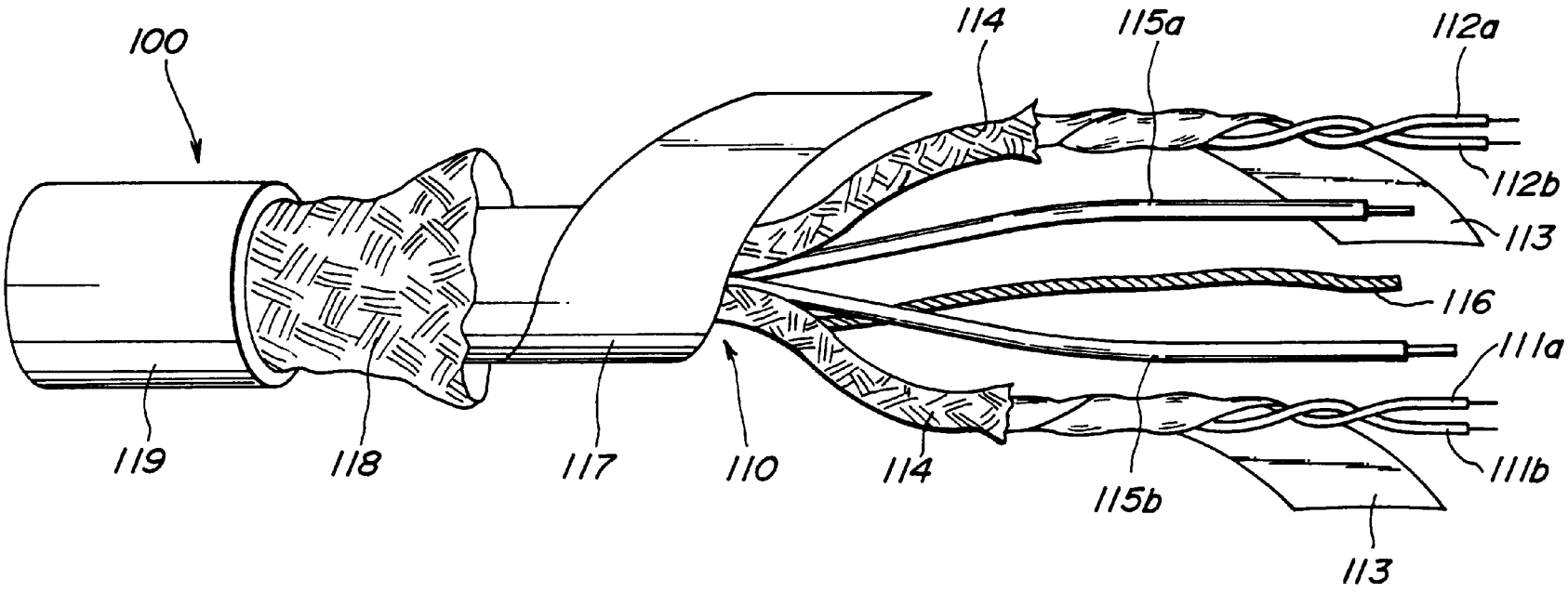
FIG. 31 is a schematic explanatory view illustrating a cable used in the present invention, whose shield braids and the like are partially removed to expose wires.
Figure 32:
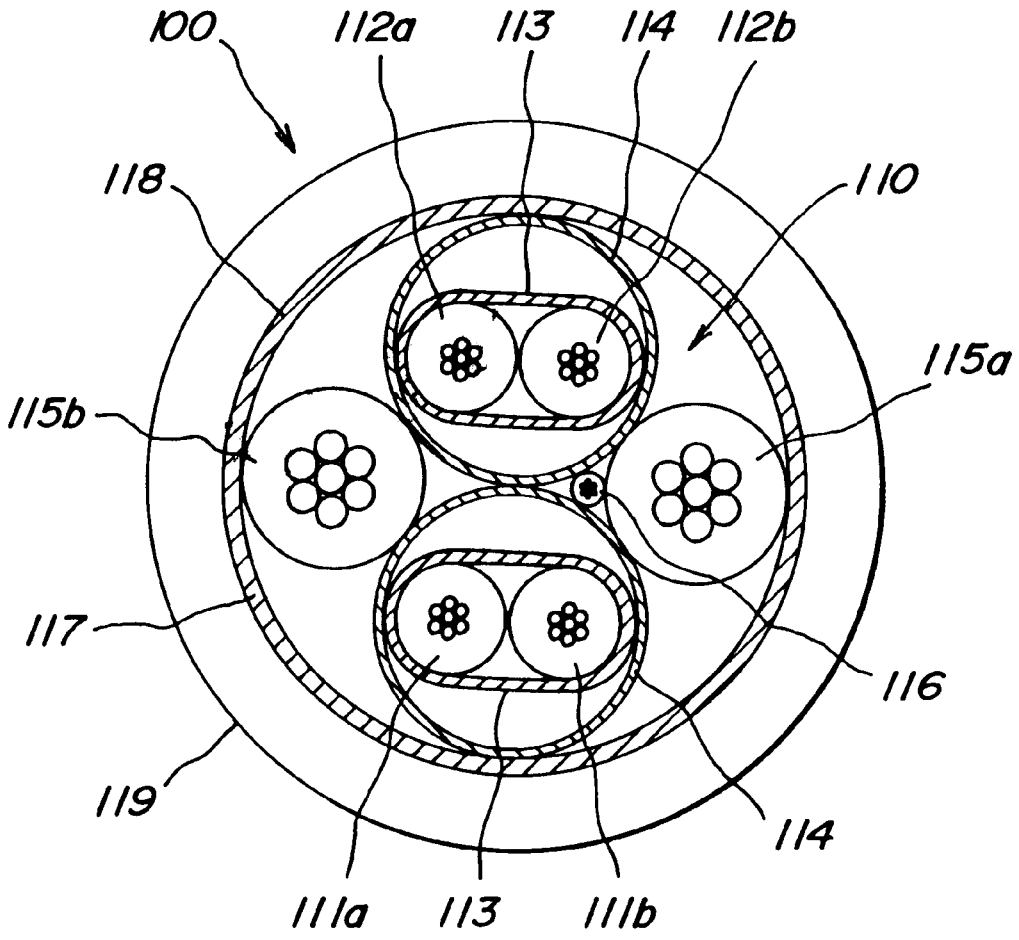
FIG. 32 is a cross-sectional view of the cable shown in FIG. 31.

The electrical connector 10 is used for instance to connect a personal computer with its peripheral equipment by a cable 100 of which construction is shown in FIGS. 31 and 32. The electrical connector 10 is connected to a mating connector 300 mounted on the base plate 200 of the personal computer or of the peripheral equipment. The mating connector 300 is mounted at connector mounting portion of the base plate 200.

The housing 20 of the electrical connector 10 is formed of a plastic molded member having substantially hexagonal cross-section. However, it is also possible to make it as a rectangular or triangular cross-section. The housing 20 is formed at its longitudinal inside with a contact receiving portion 21 having an array of contact mounting holes 22 to mount contacts 50 inserted therein.

Figure 7:
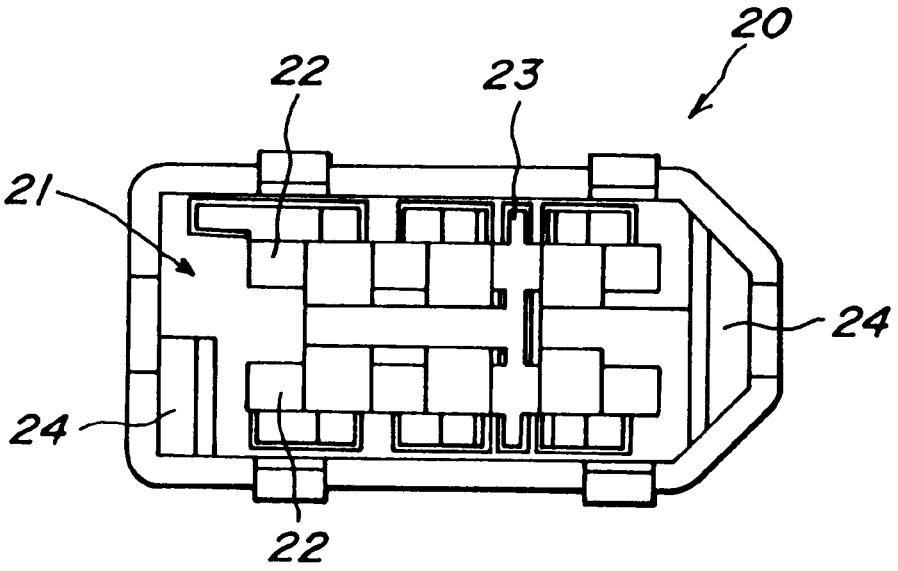
FIG. 7 is a side view illustrating the housing of the electrical connector viewed in the direction of an arrow A in FIG. 5.
Figure 8:
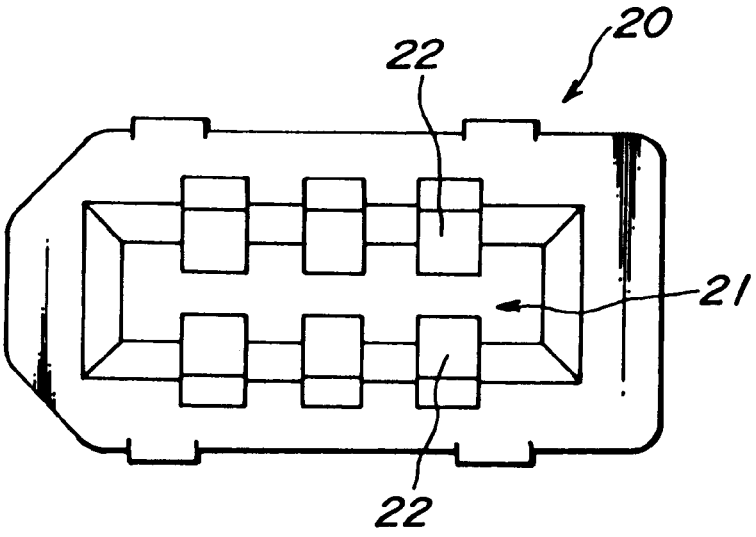
FIG. 8 is a side view illustrating the housing of the electrical connector viewed in the direction of an arrow B in FIG. 5.
Figure 9:
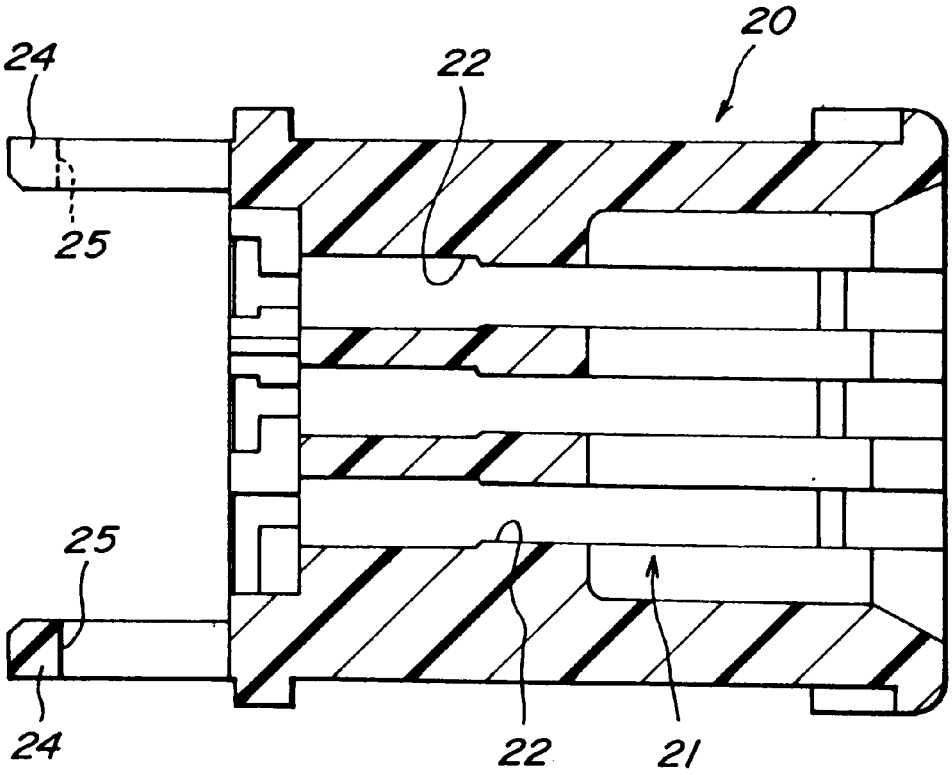
FIG. 9 is a cross-sectional view illustrating the housing of the electrical connector taken along the line 9—9 in FIG. 6.
Figure 10:
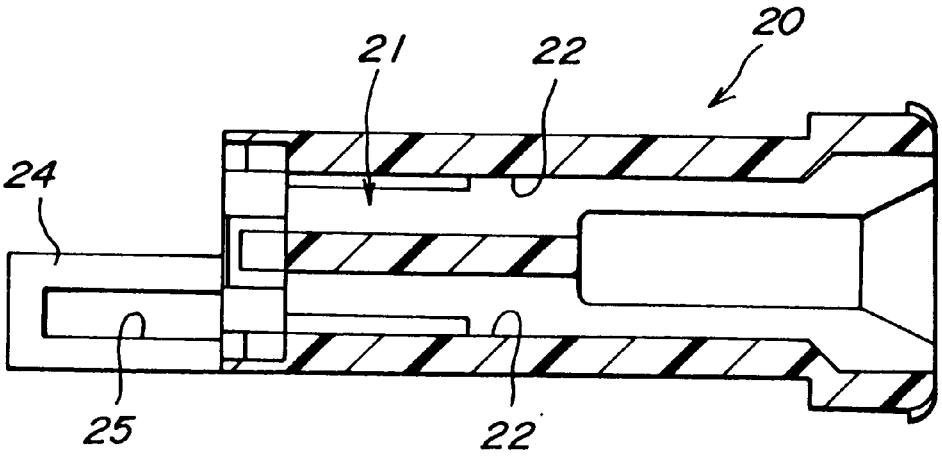
FIG. 10 is a cross-sectional view illustrating the housing of the electrical connector taken along the line 10—10 in FIG. 5.

In the illustrated embodiment, as shown in FIGS. 7 and 8 the contact mounting holes 22 are arranged in three laterally arranged top and bottom pair to match with the wires of the cable 100. More precisely, the contact mounting holes 22 are arranged to match with the forward direction signal pair wires 112*a* and 112*b* and the backward direction signal pair wires 112*a* and 112*b* and a pair of power supply wires 115*a* and 115*b*.

Figure 3:
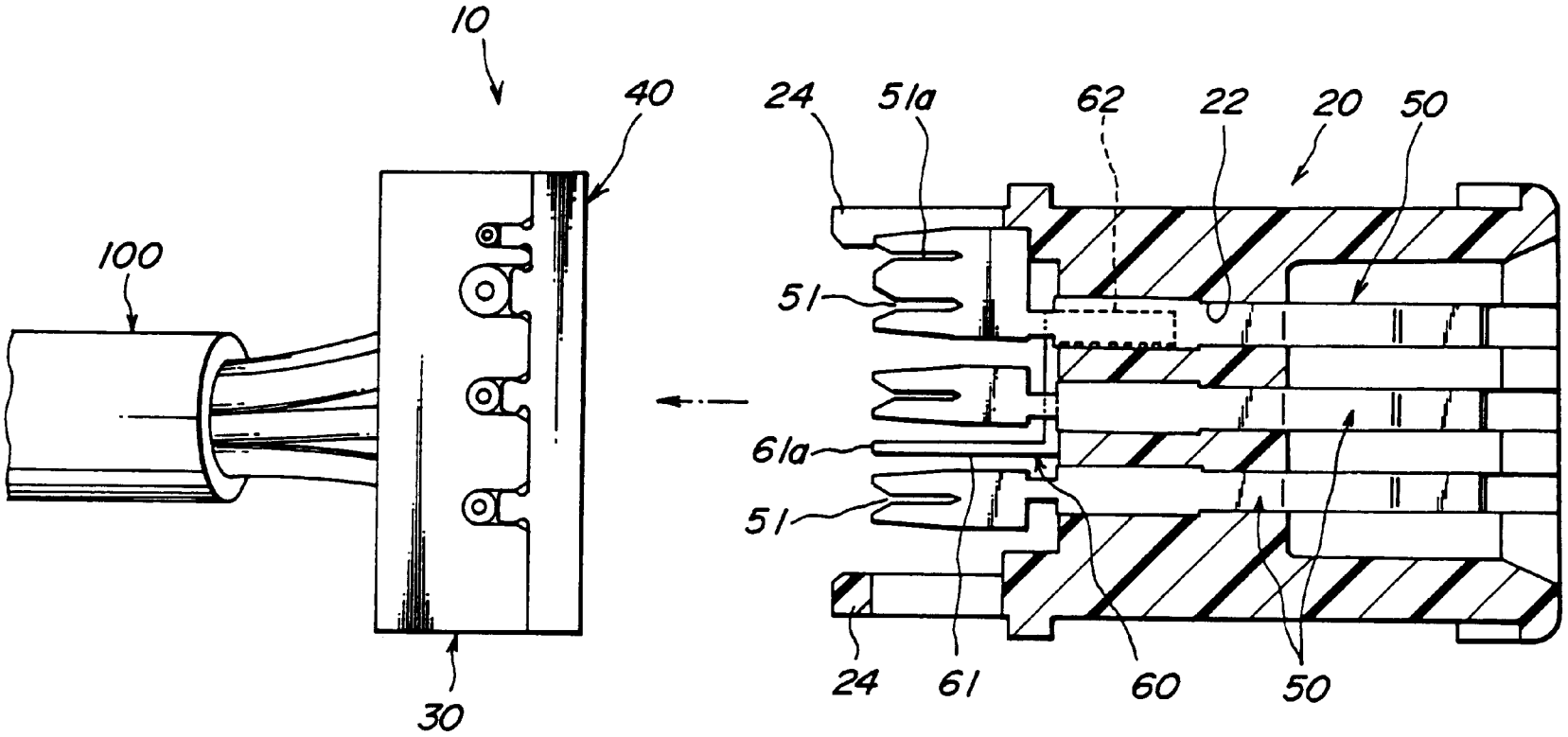
FIG. 3 is a partly longitudinal-sectional and plan view illustrating the inside of the electrical connector according to the invention and distributed wires of a cable.
Figure 4:
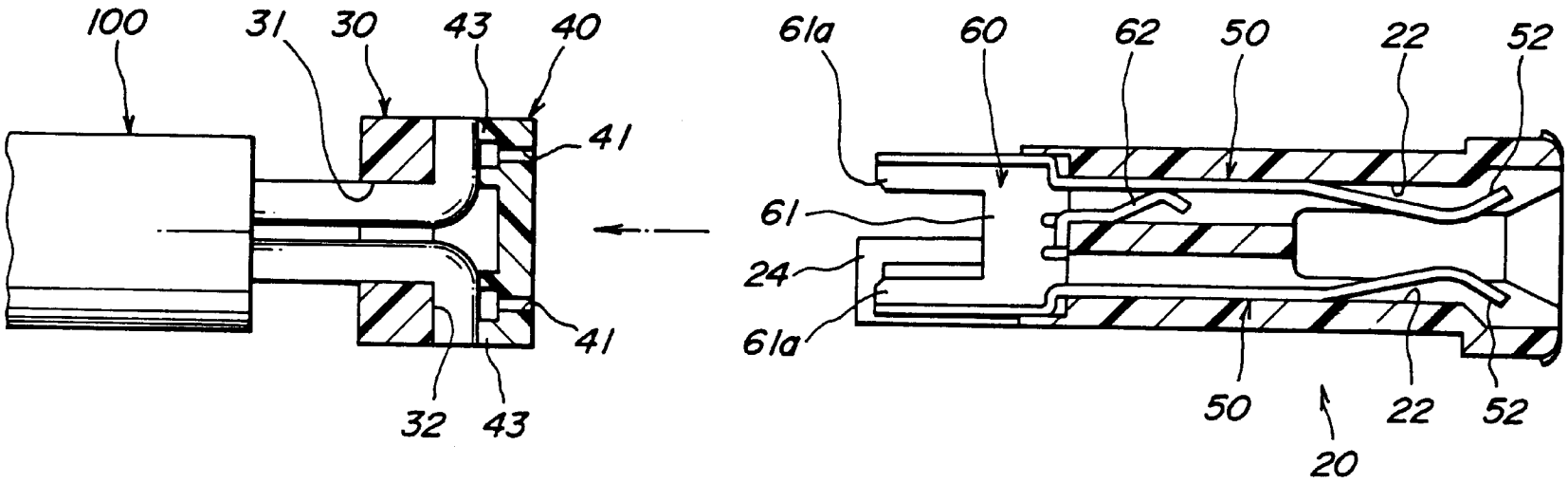
FIG. 4 is a partly longitudinal-sectional and side view illustrating the inside of the electrical connector according to the invention and distributed wires of a cable.
Figure 5:
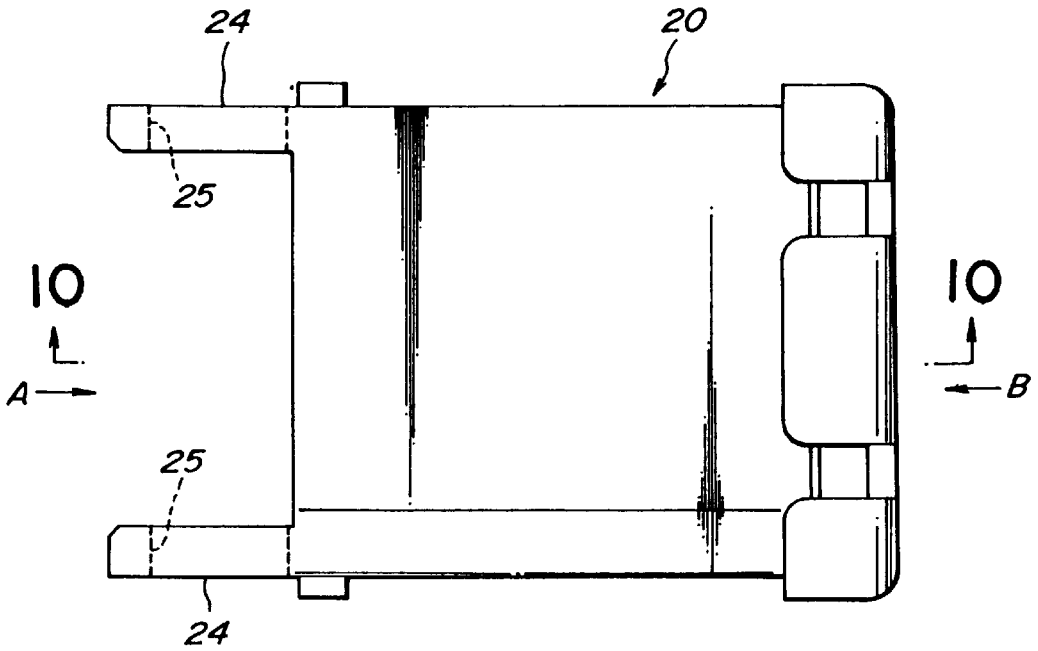
FIG. 5 is a plan view illustrating the housing of the electrical connector according to the invention.
Figure 6:
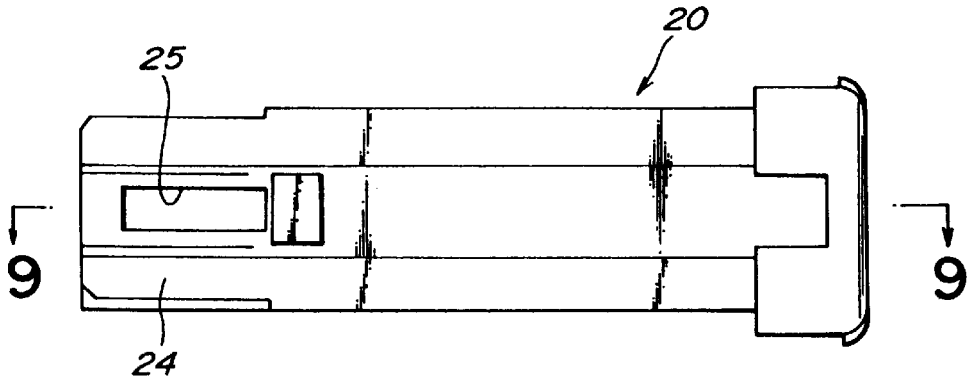
FIG. 6 is a side view illustrating a housing of the electrical connector according to the invention.
Figure 17:
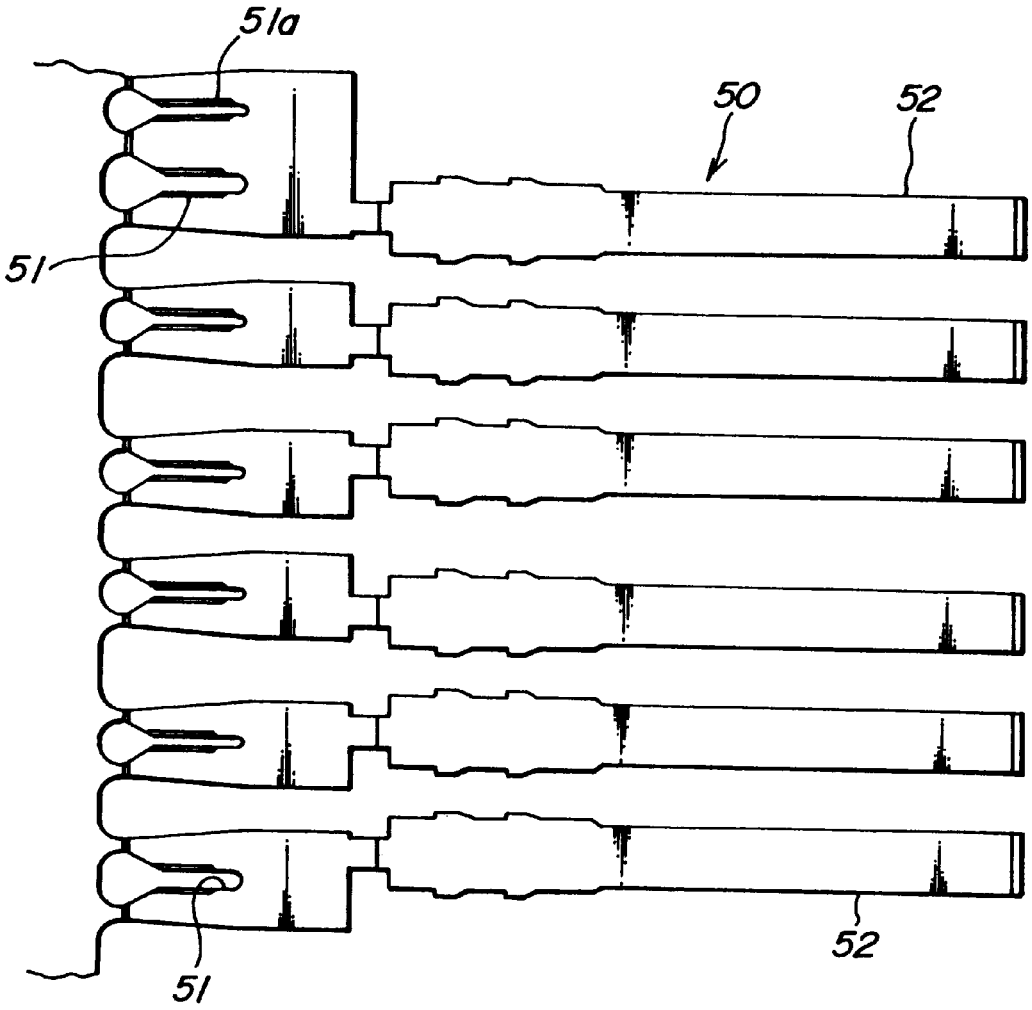
FIG. 17 is a plan view illustrating the contacts of the electrical connector according to the invention.
Figure 18:
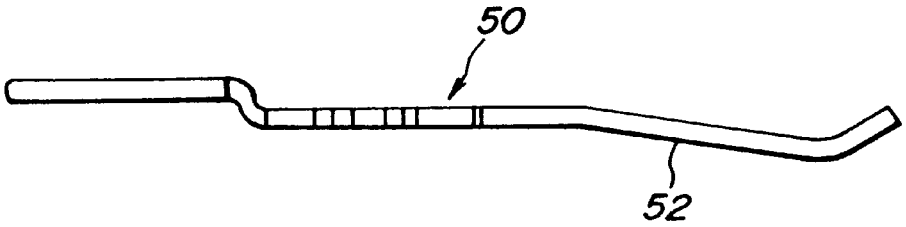
FIG. 18 is a side view illustrating the contacts of the electrical connector according to the invention.

In each of the contact mounting holes 22, the contact 50 is inserted as shown in FIGS. 3 and 4. The contacts 50 are punched out in a continuous form from a thin copper plate or the like as shown in FIGS. 17 and 18 and after separated from each other the contact 50 is inserted in the respective contact mounting hole 22.

The contact 50 is formed at one end with knife-edged grooves 51 and 51*a* each into which is pressed one of the forward direction signal pair wires 111*a* and 111*b*, the backward direction signal pair wires 112*a* and 112*b*, a pair of power supply wires 115*a* and 115*b* and a bare drain wire 116 to form piercing connections. The contact 50 is further formed with a bent contact portion 52 on the opposite side of the knife-edged grooves 51. This contact portion 52 is a portion to be in contact with a respective contact 302 of a male portion of the mating connector 300 on the side of the base plate 200 as shown in FIG. 1.

Each of the contacts 50 can be formed in substantially the same configuration. However, the contact 50 having the relatively narrow knife-edged groove 51*a* is for the bare drain wire 116 which is relatively thinner than the supply wires 115*a* and 115*b*. The relatively narrow knife-edged groove 51*a* is provided in the contact 50 together with the knife-edged groove 51 for one (earth wire) of the supply wires 115*a* and 115*b* so that such a contact 50 having the narrow knife-edged groove 51*b* is wider than the other contacts 50 and has a slightly different shape from that of the other contacts 50. Alternatively, it is also possible to provide a contact solely used for the drain wire 116 in the connector housing, into which the drain wire 116 is press-fitted, instead of the above-mentioned commonly used contact.

Figure 19:
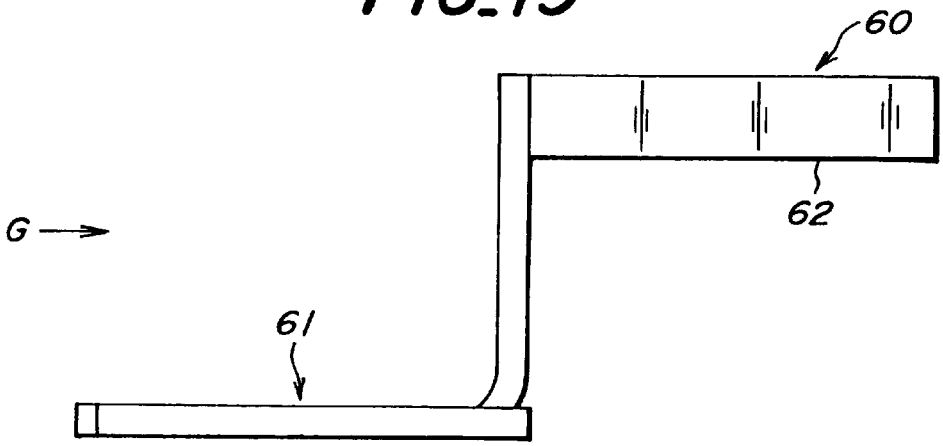
FIG. 19 is a plan view illustrating the shield plate of the electrical connector according to the invention.
Figure 20:
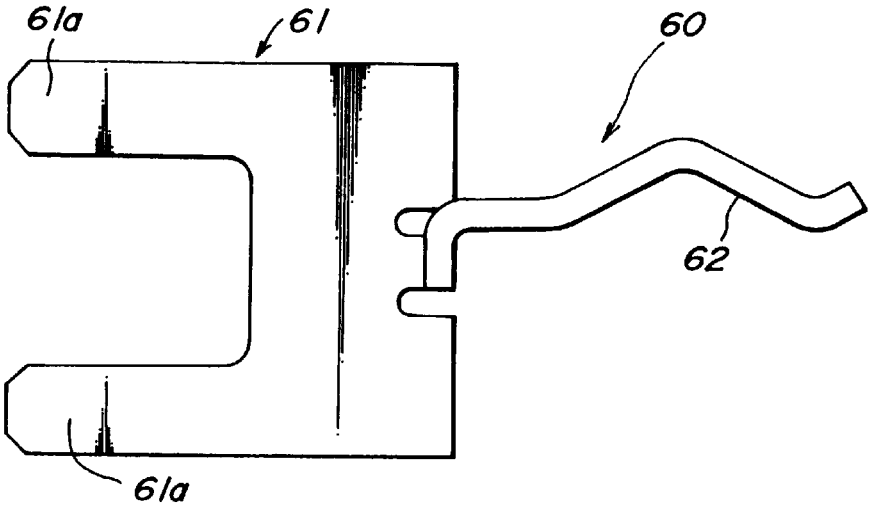
FIG. 20 is a side view illustrating the shield plate of the electrical connector according to the invention.
Figure 21:
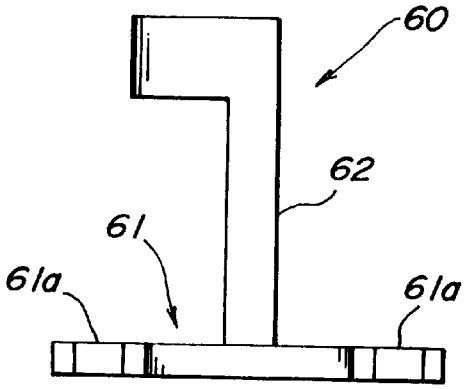
FIG. 21 is a view illustrating the shield plate viewed in the direction of an arrow G in FIG. 19.

As shown in FIGS. 19 to 21, the above-mentioned shield plate 60 comprises a substantially U-shaped flat metal shield portion 61 having two shield pieces 61*a* and a contact leg portion 62 formed by bending from the middle portion of U-shaped shield portion 61.

This shield plate 60 is mounted in a shield plate mounting hole 23 and positioned in the housing 20 as shown in FIGS. 3 and 4. The shield plate mounting hole 23 is formed between the right most first pair of contact mounting holes 22 and the second pair of contact mounting holes 22 as can be seen from FIG. 7. By this the adjacent pairs of contacts 50 respectively mounted in the first and second pairs of contact mounting holes 22 are separated by the shield pieces 61*a* and especially the knife-edged groove portions 51 and 51*a* or the piercing connection portions are separated and electrically shielded by the shield pieces 61*a*.

The bent leg portions 62 of the shield plate 60 extend toward the contact 50 for earth and become in electrical contact with the contact 50 as shown in FIGS. 3 and 4. This contact 50 has the knife-edged groove 51*a* into which is pressed the bare drain wire 116 and the knife-edged groove 51 into which is pressed one (earth wire) of the power supply wires 115*a* and 115*b*. The electrical contact between the leg portion 62 and the contact 50 is kept to have sufficient contact pressure by the spring force of the bent leg portion 62. Accordingly, the shield plate 60 is completely ground and a good shielding function can be achieved. On the other hand, by the spring force of the leg portion 62, the shield plate 60 itself is rigidly held in the housing 20.

The wire distribution block 30 is formed of a plastic molded member. The distribution block 30 serves to arrange the sheath cover removed wires of the cable 100 comprising a pair of forward direction signal wires 111*a* and 111*b*, a pair of backward direction signal wires 112*a* and 112*b* and a pair of power supply wires 115*a* and 115*b* and further a bare drain wire 116 such that these wires are snugly distributed under a predetermined order without being crossed or entangled with each other or irregularly separated.

Figure 2:
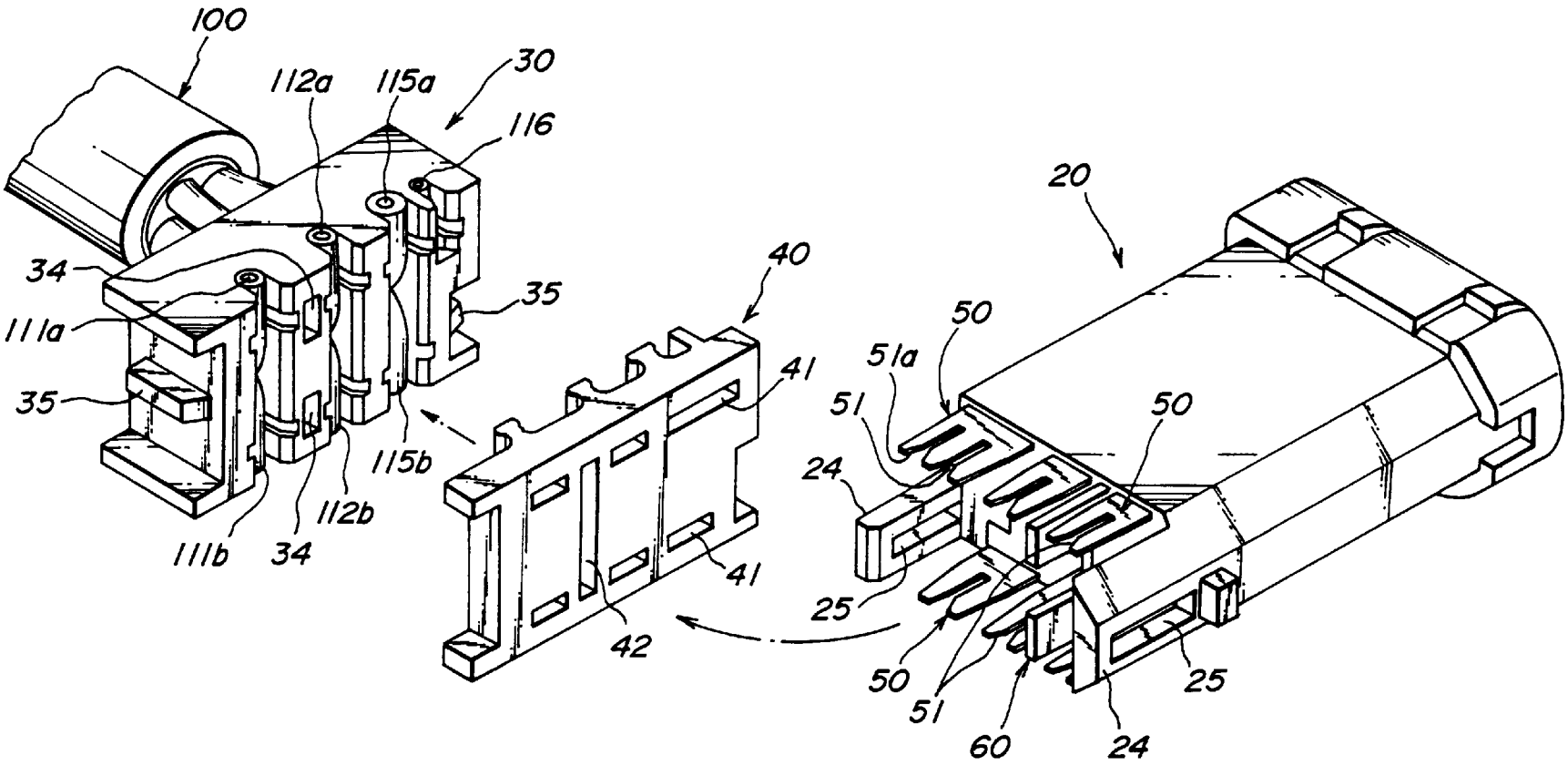
FIG. 2 is an exploded perspective view illustrating the connected state of a cable to the electrical connector according to the invention.
Figure 11:
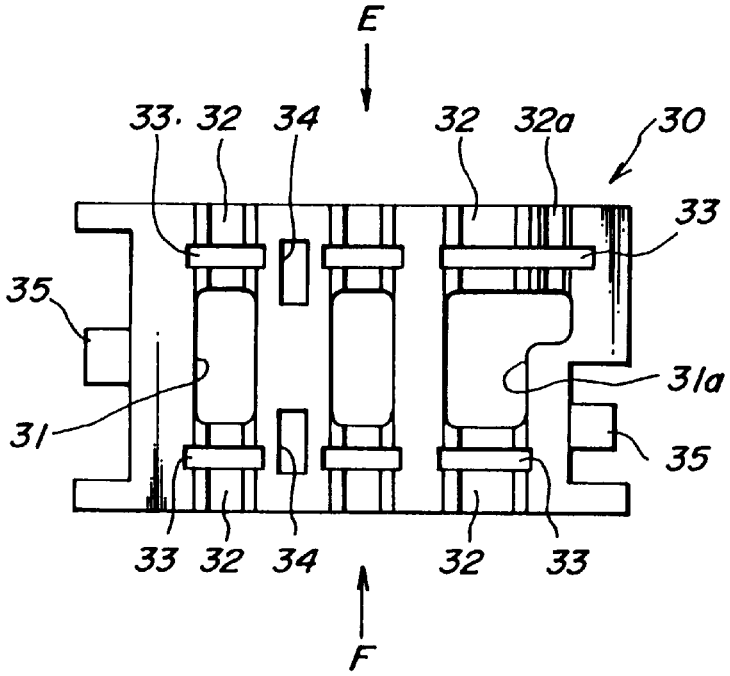
FIG. 11 is a front elevation illustrating the wire distribution block of the electrical connector according to the invention.
Figure 12:
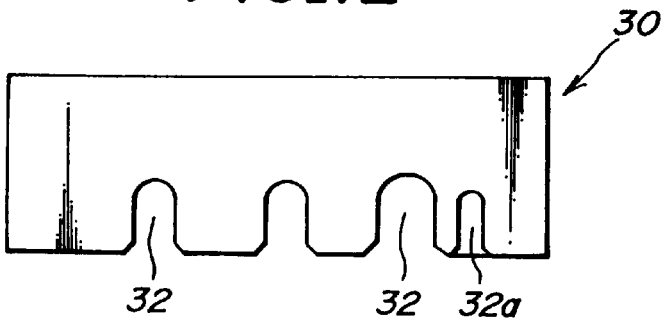
FIG. 12 is a plan view illustrating the wire distribution block viewed in the direction of an arrow E in FIG. 11.
Figure 13:
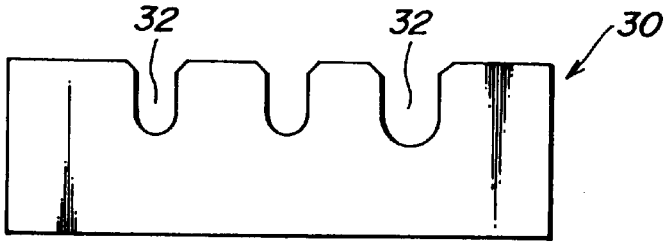
FIG. 13 is a bottom plan view illustrating the wire distribution block viewed in the direction of an arrow F in FIG. 11.

For such a purpose, the wire distribution block 30 is arranged at the end of the cable 100 where the cable sheath cover is removed as shown in FIG. 2. The wire distribution block 30 is formed at the central portion with for example three wire passing holes 31, 31 and 31*a* through which the respective wires 111*a* and 111*b*, 112*a* and 112*b*, 115*a* and 115*b* and the bare drain wire 116 are passed as shown in FIG. 11. Furthermore, as shown in FIGS. 11 to 13, in the front end surface of the block 30, i.e. on the opposite side of the cable 100, wire distribution grooves 32 are provided extending from the wire passing holes 31, 31 and 31*a*in upper and lower directions thereof. These wire distribution grooves 32 have substantially U-shaped cross-section. Also a narrow width wire distribution groove 32*a* is provided in the block 30 in the proximity of one of the wire distribution grooves 32 on the side of the wire passing hole 31*a*.

In the wire distribution grooves 32 extending in two directions, the forward direction signal wire pair 111*a* and 111*b*, the backward direction signal wire pair 112*a* and 112*b* and the pair of supply wire 115*a* and 115*b* are placed to fit into the upward grooves 32 and downward grooves 32 respectively by snugly divided into two groups. The bare drain wire 116 is closely fitted in the narrow width distribution groove 32*a*.

At around middle portion of the above-mentioned wire distribution grooves 32 and 32*a*, and in the direction of front to rear of the wire distribution block 30, there are provided contact passing-through holes 33 each for passing the piercing connection portion of the contact 50 having knife-edged grooves 51 and 51*a* in the housing 20 and shield plate passing-through holes 34 for passing the two shield pieces 61*a* of the shield plate 60.

Figure 14:
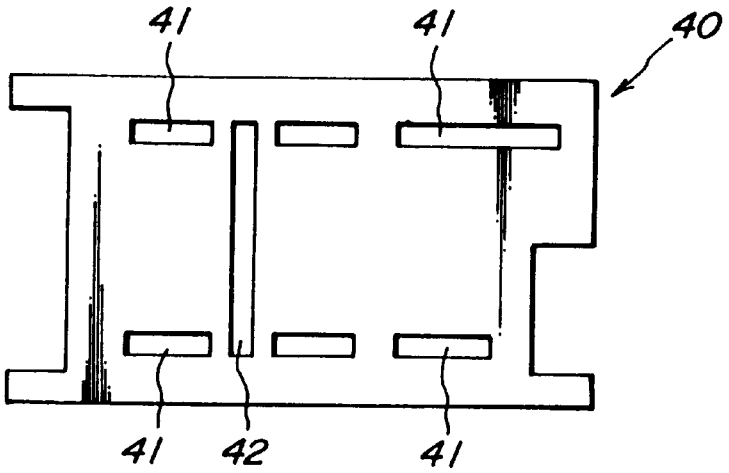
FIG. 14 is a front elevation illustrating the block cover of the electrical connector according to the invention.
Figure 15:
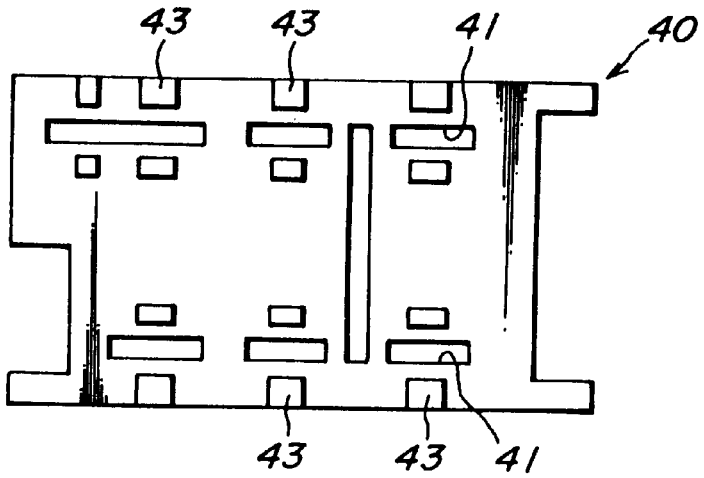
FIG. 15 is a back elevation illustrating the block cover of the electrical connector according to the invention.
Figure 16:
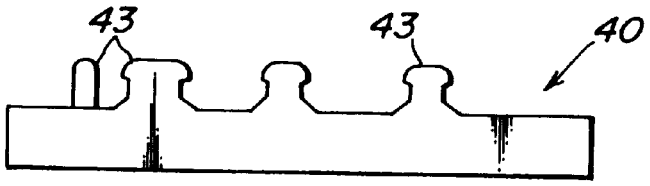
FIG. 16 is a side view illustrating the block cover of the electrical connector according to the invention.

The block cover 40 serves to cover the front side of the wire distribution block 30 and in the front to rear direction thereof, there are provided contact-through holes 41 each for passing the piercing connection portion of the contact 50 having knife-edged grooves 51 and 51*a* in the housing 20 and shield plate passing-through holes 42 for passing the two shield pieces 61*a* of the shield plate 60 as shown in FIG. 14. On the other hand, on the rear side of the block cover 40 pressing projections 43 are provided to press the respective wires 111*a* and 111*b*, 112*a* and 112*b*, 115*a* and 115*b* fitted in the wire distribution grooves 32 and 32*a* of the wire distribution block 30 on their outside.

The method for connection of a cable according to the present invention claimed in claim 4 by the use of the electrical connector thus constructed will be explained hereinafter by referring to FIGS. 22 to 29.

Figure 22:
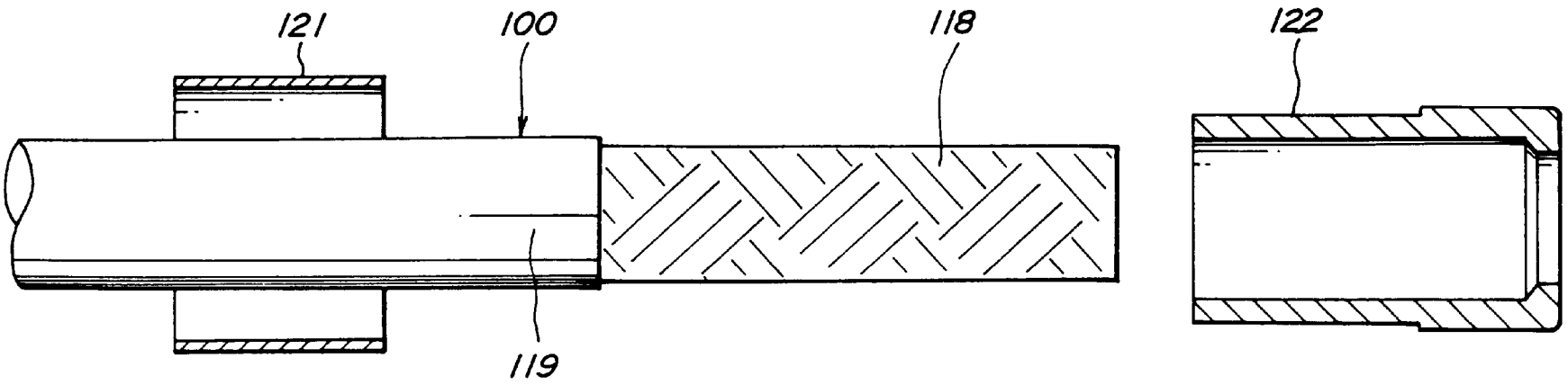
FIG. 22 is a schematic explanatory view illustrating one state of the end of a cable with partially removed its insulating sheath to expose its outer shield braid in the method according to the invention.
Figure 23:
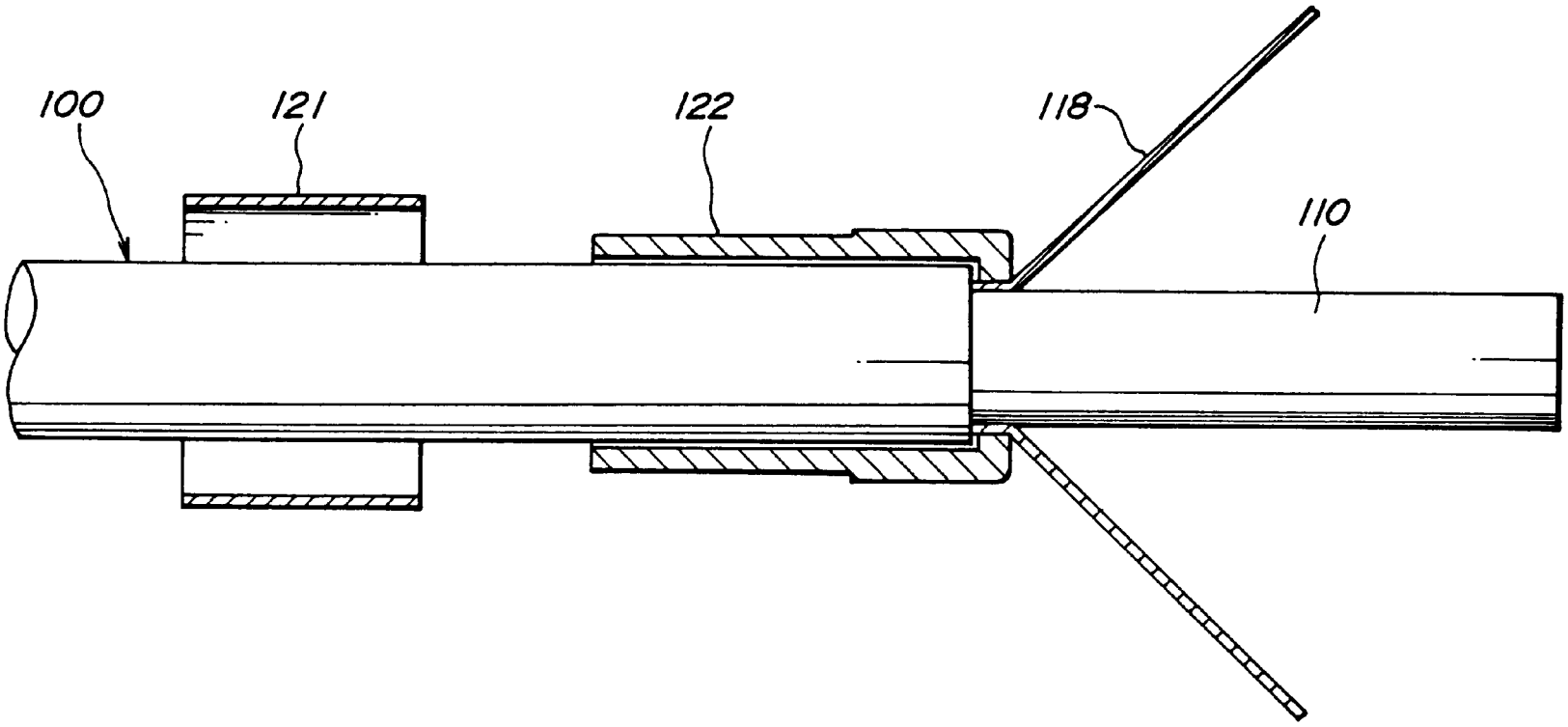
FIG. 23 is a schematic explanatory view illustrating one state of the end of a cable with a cable body cap and with dismembered outer shield braid in the method according to the invention.
Figure 24:
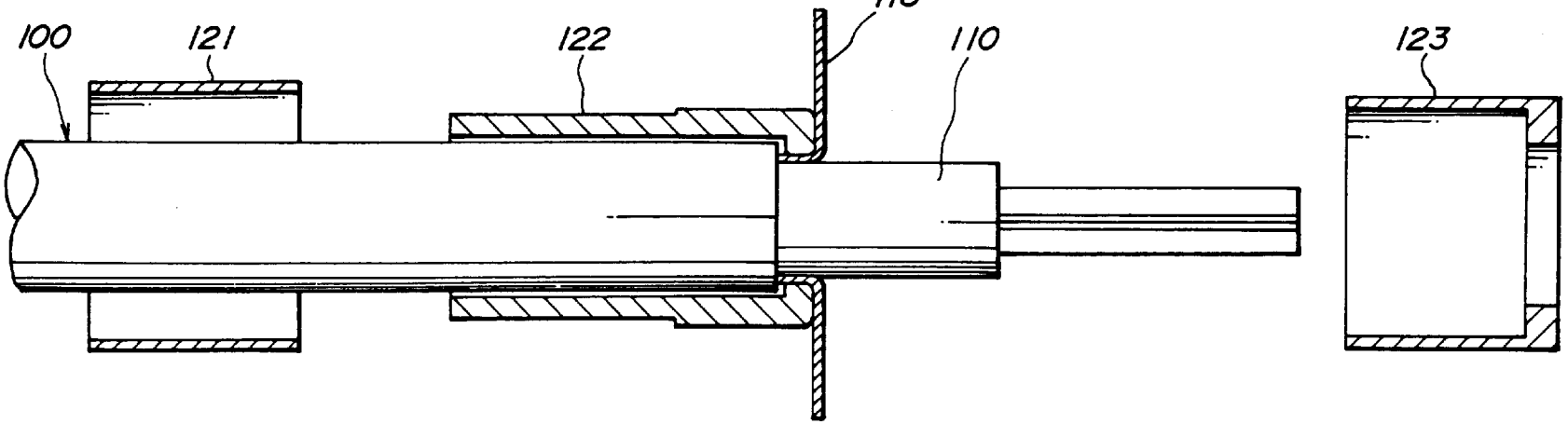
FIG. 24 is a schematic explanatory view illustrating one state of the end of a cable with partially removed cable core in the method according to the invention.
Figure 25:
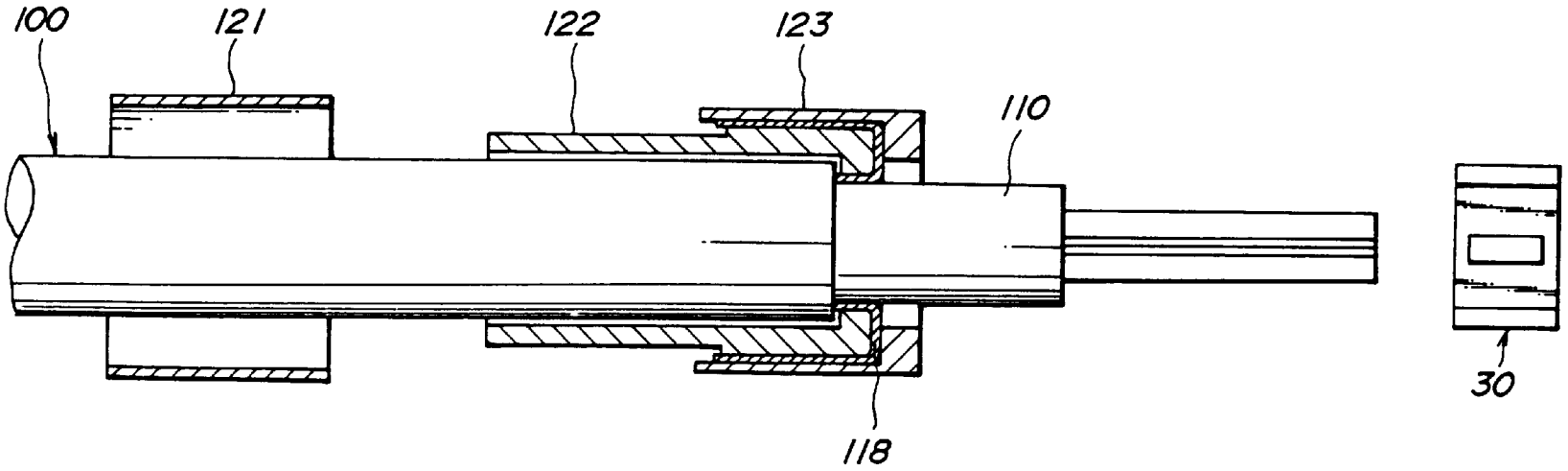
FIG. 25 is a schematic explanatory view illustrating one state of the end of a cable with braid urging cap in the method according to the invention.

First, an outer cable end cap 121 is previously fitted on the end of a cable 100 and the sheath 119 at the end of the cable is partially removed to expose the outer shield braid 118 of a predetermined length (FIG. 22). A cable body cap 122 is fitted on the end of the cable so as to extend the exposed shield braid out of the cable body cap 122, and the extended exposed shield braid 118 is loosened (FIG. 23). After the loosened shield braid 118 is cut to a suitable length, the sheath cover is partially removed to expose part of the cable core 110 (FIG. 24) and a braid urging cap 123 is fitted on the remaining shield braid 118 (FIG. 25).

Figure 26:
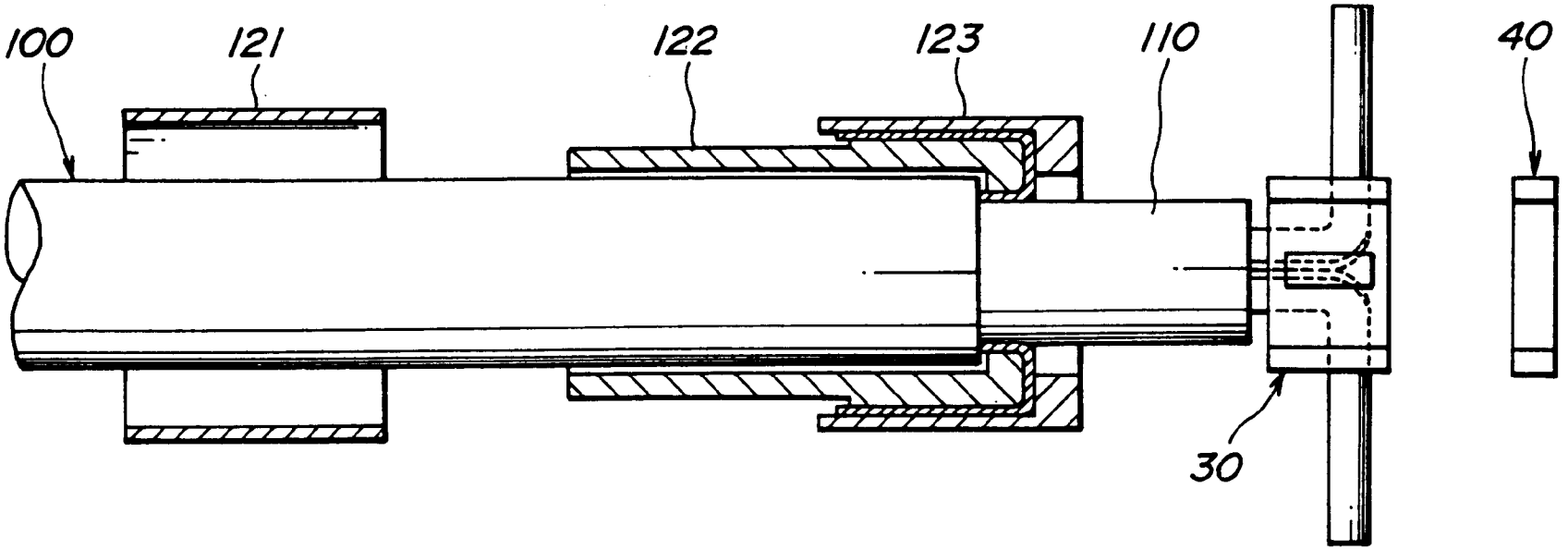
FIG. 26 is a schematic explanatory view illustrating the distribution of wires in the distribution block in the method according to the invention.
Figure 27:
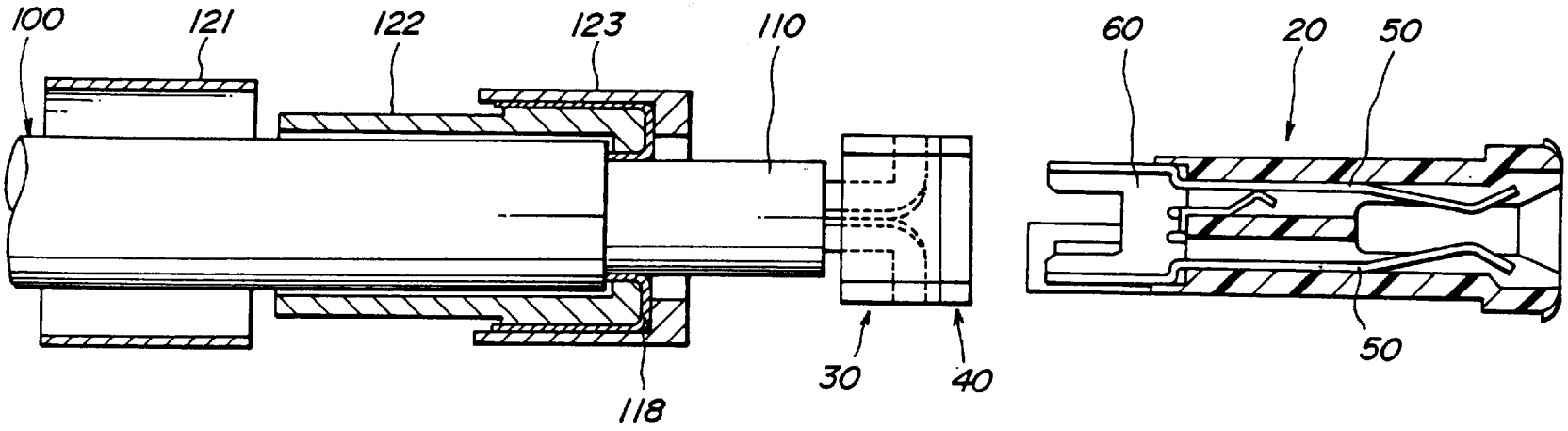
FIG. 27 is a schematic explanatory view illustrating the block cover mounted on the wires in the wire distribution block in the method according to the invention.

Thereafter, shield braids or insulating covers are partially removed from a pair of forward direction signal wires 111*a* and 111*b*, a pair of backward direction signal wires 112*a* and 112*b*, a pair of power supply wires 115*a* and 115*b* and a bare drain wire 116 to expose the wires from the cable core 110. These wires are passed through the corresponding wire passing holes 31 and 31*a* of the wire distribution block 30, while the pairs of signal wires 111*a* and 111*b* and 112*a* and 112*b* and the pair of power supply wires 115*a* and 115*b* are snugly fitted in the wire distribution grooves 32 of the wire distribution block 30 in a manner such that these wires are separated into two directions, i.e. upper and lower directions. The bare drain wire 116 is fitted in the narrow width distribution groove 32*a* (FIG. 26). After portions of these wires extending from the grooves are cut off, the block cover 40 is mounted on the front surface of the wire distribution block 30 (FIG. 27). As an alternative, the block cover 40 may be brought into abutment with the front surface of the wire distribution block 30.

In this manner, the respective wires 111*a* and 111*b*, 112*a* and 112*b*, and 115*a* and 115*b* and the bare drain wire 116 are distributed in short length. Moreover, these wires are directed according to a predetermined rule (division system of pairs of wires into upper and lower directions) without being crossed or entangled with each other. In other words, the respective wires 111*a* and 111*b*, 112*a* and 112*b*, and 115*a* and 115*b* and the bare drain wire 116 extending in the longitudinal direction of the cable are bent into upper and lower directions linearly along the distribution grooves 32 and 32*a* so that these wires are separated and securely fixed.

In this case, moreover, the insulating cover portions of plastic materials or the like of the wires 111*a* and 111*b*, 112*a* and 112*b*, and 115*a* and 115*b* may be maintained without being removed and therefore there is no need for removal of insulating covers of wires which is a troublesome operation particularly in case of fine wires.

Figure 28:
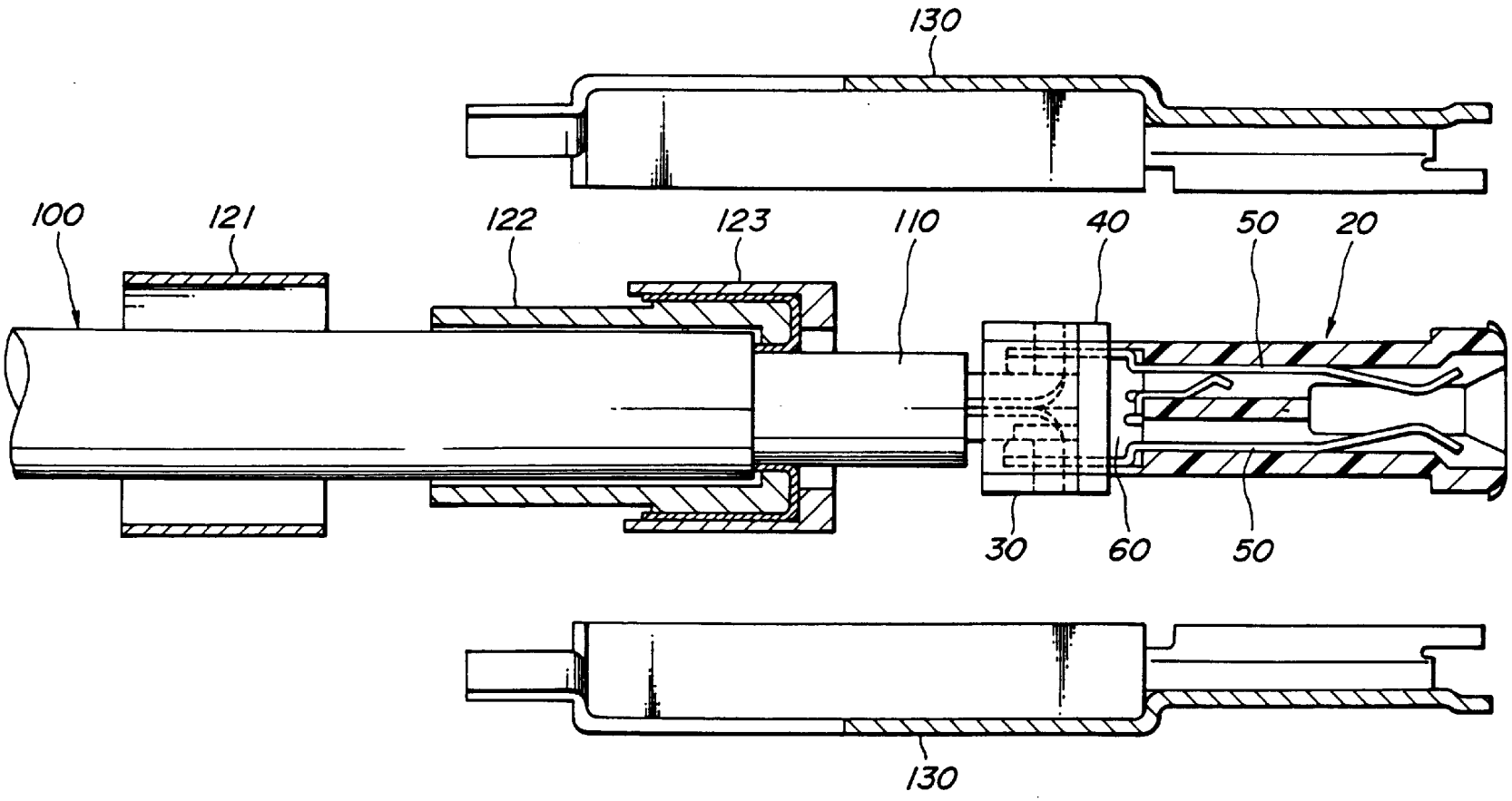
FIG. 28 is a schematic explanatory view illustrating the connection of the wire distribution block to the housing in the method according to the invention.
Figure 29:
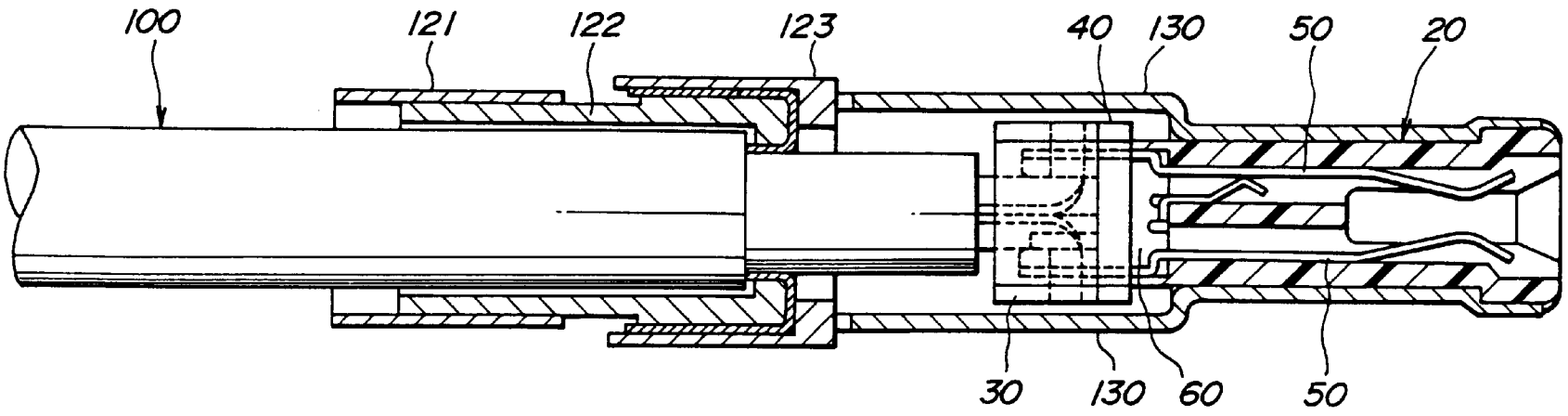
FIG. 29 is a schematic explanatory view illustrating the connector cover connected to the wire distribution block and the housing in the method according to the invention.

By simply forcing the wire distribution block 30 onto the piercing connection portions having the knife-edged grooves 51 and 51*a* of the contacts in the housing 20, the respective wires 111*a* and 111*b*, 112*a* and 112*b*, and 115*a* and 115*b* and the bare drain wire 116 distributed and fitted in the distribution grooves 32 and 32*a* are forced into the knife-edged grooves 51 and 51*a* to accomplish the piercing connection of these wires in a simple manner (FIG. 28).

In this case, the widths of the knife-edged grooves 51 and 51*a* are slightly less than diameters of the corresponding conductors of wires so that the knife-edges of the grooves pierce into the insulating coverings and further into the conductors of the wires to be electrically connected to the conductors to form piercing connections.

Moreover, when the wire distribution block 30 is forced onto the piercing connection portion of the connector, the piercing connection portions of the knife-edged grooves of the contacts advance into the wire distribution block 30 as described above and at the same time the two shield pieces 61*a* of the shield plate 60 also advance into the wire distribution block 30 so that a shielding is accomplished between the pair of forward direction signal wires 111*a* and 111*b* and the pair of backward direction signal wires 112*a* and 112*b* in a substantially complete manner even at the bottom of the shield braid removed cable end.

Furthermore, the wire distribution block 30 is provided with mating protrusions 35 on both the sides as shown in FIG. 11. When the wire distribution block 30 being forced, the fitting protrusions 35 are fitted in fitting apertures 25 formed in elastic extensions 24 of the housing 20 which extend between upper and lower rows of the contacts 50. Therefore, the wire distribution block 30, the block cover 40 and the housing 20 are integrally fixed to each other.

Thereafter, a connector cover 130 for example divided into two cover halves is fitted on the housing 20 and the wire distribution block 30 so as to cover these members (FIG. 29), and an outer cover 140 is fitted thereon as shown in FIG. 1 to complete the connection of the cable to the electrical connector according to the invention. With this connection effected as described above, it is possible to effectively prevent any occurrence of cross talk and transmission losses.

Figure 30:
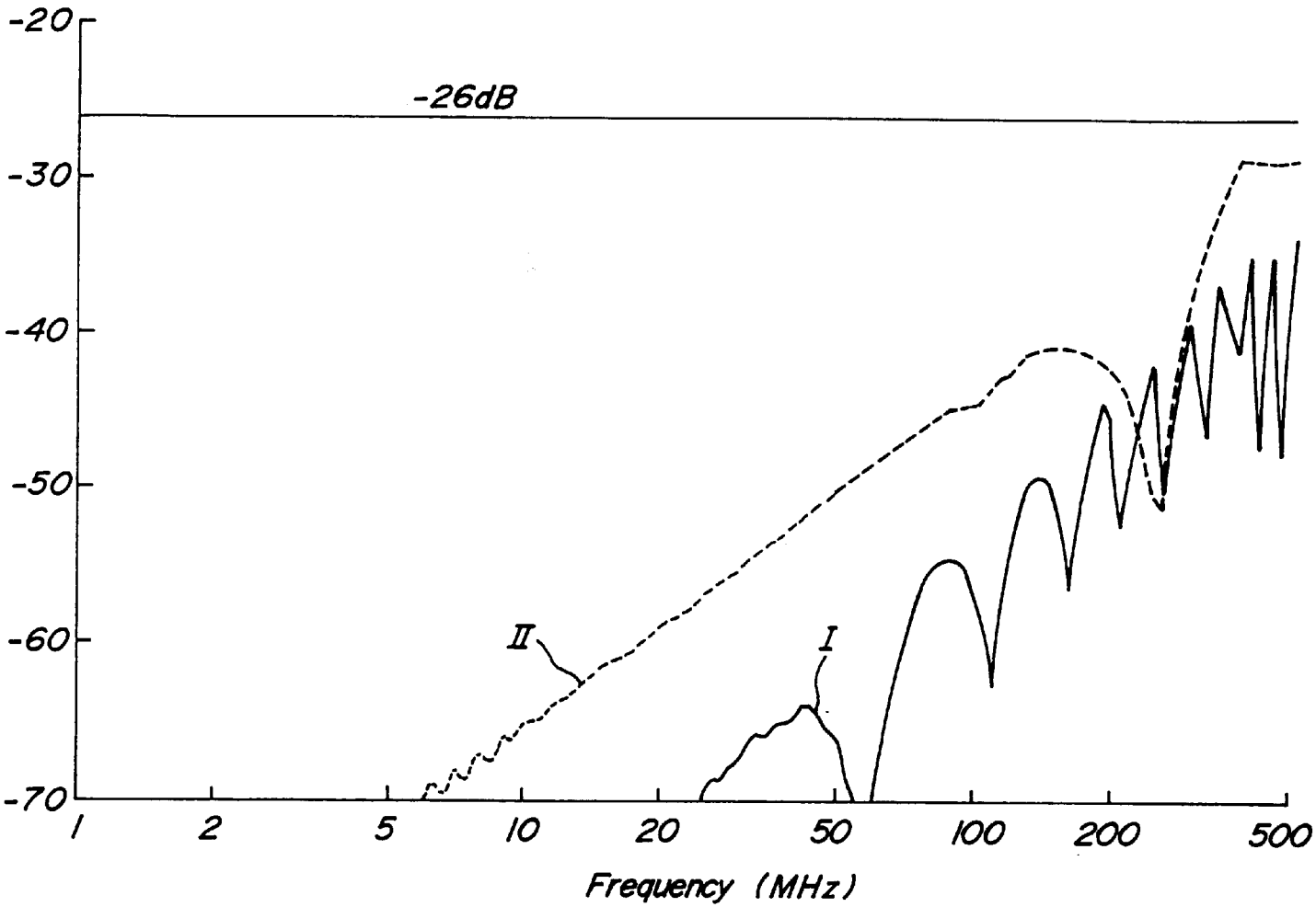
FIG. 30 is a graph illustrating the relationship between cross talk and frequencies in the connection to the connector according to the invention.

In this connection, FIG. 30 illustrates curves I in a graph showing the relationship between cross talk and frequencies with the connection of the cable 100 to the electrical connector according to the invention. In this measurement, the length of the cable 100 was 4.5 m. In another measurement for reference, wires and a drain wire of a cable whose sheath was partially removed were connected to contacts of an electrical connector by soldering. The cable was substantially the same as the cable 100 but had a length of 0.7 m. FIG. 30 illustrates Curves II showing the relationship between cross talk and frequencies in this case.

In comparison with these curves, the occurrence of cross talk is effectively prevented even at high frequencies with the connector according to the invention, while on the other hand with the connector of the prior art using soldering, the effect for preventing the cross talk is much less than in the present invention owing to lengthening of wires, inconstant amount of required solder, and tendency for wires to be slackened to make difficult the constant wiring with high accuracy.

While the methods of connection to the electrical connectors 10 claimed in claims 2 and 4 have been described in the above embodiments, it will be apparent that the present invention will be not limited to these embodiments.

For example, in providing the shield plate 60 into the electrical connector, a plurality of contacts not forming pairs as in claim 1 may be used without being limited to the connectors having plural sets of contact pairs.

In connecting a cable to the electrical connector, the present invention is applicable to a cable not having a pair of power supply wires as in the connecting method claimed in claim 3. In this case, a contact for a drain wire may be provided in the housing as required.

Moreover, the shield plate is not limited to the shield plate 60 including the U-shaped shield portion 61 having the two shield pieces 61*a,* while the shield plate may be simply rectangular. In this case, the shield plate passing-through holes 34 formed in the wire distribution block 30 may be a vertical continuous hole which is not divided into two holes.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A method for connecting a cable to an electrical connector, said cable including a cable core composed of sets of signal pair wires covered with individual shield braids and a bare drain wire interposed between said sets of signal pair wires, an outer shield braid covering said cable core and a sheath covering said outer shield braid, and said electrical connector including a housing having a contact receiving portion therein, a plurality of contacts arranged in a row in said contact receiving portion, each of said contacts having at its leading end connection portion a knife-edged groove for insulation piercing connection, and a shield plate provided between at least two adjacent contact pairs for said signal pair wires, said method comprising steps of:

exposing said wires at one end of said cable to be connected by partially removing said shield braids or others;

preparing a wire distribution block having wire passing holes through which said exposed sets of signal pair wires and said bare drain wire are passed and wire distribution grooves formed and distributed in two directions in the front end surface of said wire distribution block, and passing said sets of signal pair wires and bare drain wire through said wire passing holes, while distributing said sets of signal pair wires and bare drain wire extended through said wire passing holes to fit these wires in said wire distribution grooves;

cutting off parts of said distributed sets of signal pair wires and bare drain wire extending from said wire distribution grooves;

mounting a block cover on said wire distribution block; and forcing said wire distribution block with said cable connected thereto to the wire connection portion of said electrical connector through said block cover to pierce said knife-edged grooves of the corresponding contacts into conductors of said sets of signal pair wires and bare drain wire fitted in said wire distribution grooves to electrically connect said cable to said electrical connector.

2. A method for connecting a cable to an electrical connector, said cable including a cable core composed of sets of signal pair wires covered with individual shield braids, a pair of power supply wires interposed between said signal pair wires and a bare drain wire interposed between said sets of signal pair wires and in electrical contact with individual shield braids of said signal pair wires, an outer shield braid covering said cable core and a sheath covering said outer shield braid, and said electrical connector including a housing having a contact receiving portion therein, a plurality of contacts arranged in a row in said contact receiving portion, each of said contacts having at its leading end connection portion a knife-edged groove for piercing connection, and a shield plate provided between at least two adjacent contact pairs for said signal pair wires, said method comprising steps of:

exposing said wires at one end of said cable to be connected by partially removing said shield braids or others;

preparing a wire distribution block having wire passing holes through which said exposed sets of signal pair wires, said pair of power supply wires and said bare drain wire are passed and wire distribution grooves formed and distributed in two directions in the front end surface of said wire distribution block, and passing said sets of signal pair wires, pair of power supply wires and said bare drain wire through said wire passing holes, while distributing said sets of signal pair wires, pair of power supply wires and bare drain wire extended through said wire passing holes to fit these wires in said wire distribution grooves;

cutting off parts of said distributed sets of signal pair wires, pair of power supply wires and bare drain wire extending from said wire distribution grooves;

mounting a block cover on said wire distribution block; and forcing said wire distribution block with said cable connected thereto to the wire connection portion of said electrical connector through said block cover to pierce said knife-edged grooves of the corresponding contacts into conductors of said sets of signal pair wires, pair of power supply wires and bare drain wire fitted in said wire distribution grooves to electrically connect said cable to said electrical connector.

3. A method for connecting a cable to an electrical connector as set forth in claim 1, wherein said drain wire is connected to one of contacts in said housing.

4. A method for connecting a cable to an electrical connector as set forth in claim 1, wherein part of said shield plate is brought into electrical contact with the contact in said housing, said contact being connected to said drain wire, whereby said shield plate is ground.

5. A method for connecting a cable to an electrical connector as set forth in claim 2, wherein said drain wire is connected to one of contacts in said housing.

6. A method for connecting a cable to an electrical connector as set forth in claim 2, wherein part of said shield plate is brought into electrical contact with the contact in said housing, said contact being connected to said drain wire, whereby said shield plate is ground.

7. A method for connecting a cable to an electrical connector as set forth in claim 3, wherein part of said shield plate is brought into electrical contact with the contact in said housing, said contact being connected to said drain wire, whereby said shield plate is ground.

* * * * *